US007148433B1

(12) United States Patent
Rudy, Jr.

(10) Patent No.: US 7,148,433 B1
(45) Date of Patent: Dec. 12, 2006

(54) REVERSING SWITCH MECHANISM

(75) Inventor: William J. Rudy, Jr., Annville, PA (US)

(73) Assignee: Tyco Electronics Corporation, Middletown, DE (US)

( * ) Notice: Subject to any disclaimer, the term of this patent is extended or adjusted under 35 U.S.C. 154(b) by 0 days.

(21) Appl. No.: 11/330,831

(22) Filed: Jan. 12, 2006

(51) Int. Cl.
*H01H 9/00* (2006.01)
*H01H 15/00* (2006.01)

(52) U.S. Cl. ..... 200/1 V; 200/16 C; 200/16 D

(58) Field of Classification Search ..... 200/1 V, 200/6 R, 16 R–16 D, 553, 557–559, 561, 200/332, 335, 547, 549–551
See application file for complete search history.

(56) References Cited

U.S. PATENT DOCUMENTS 3,097,269 A * 7/1963 Campbell ..... 200/16 C
3,699,292 A * 10/1972 Ohkita ..... 200/259
3,742,364 A 6/1973 Mathews
4,168,405 A * 9/1979 Raab et al. ..... 200/1 V
4,450,323 A * 5/1984 Iitsuka ..... 200/1 V
4,563,551 A * 1/1986 Black et al. ..... 200/16 C
4,695,692 A * 9/1987 Noda ..... 200/335
4,777,393 A 10/1988 Peot
4,864,083 A 9/1989 Bittel
4,903,318 A * 2/1990 Nagata ..... 388/840
4,968,922 A 11/1990 Bittel
5,051,547 A 9/1991 Nagata et al.
5,089,729 A 2/1992 Moores, Jr.
5,225,727 A 7/1993 Melrose et al.
5,322,983 A * 6/1994 Tseng ..... 200/549
5,629,504 A * 5/1997 Chang ..... 200/16 C
5,783,785 A * 7/1998 Furukawa ..... 200/1 B
5,824,977 A * 10/1998 Takano et al. ..... 200/16 C

* cited by examiner

*Primary Examiner*—Michael A. Friedhofer

(57) ABSTRACT

A reversing switch mechanism includes a housing defining contact cavities and a trough, contacts received in the contact cavities, and a slide member received in the trough and engaging the contacts. The slide member includes conductive elements forming conductive paths along the slide member. The slide member movable with respect to the contacts along a linear path between a forward position and a rearward position, wherein the contacts engage the conductive elements in a first conductive configuration in the forward position and the contacts engage the conductive elements in a second conductive configuration in the rearward position.

20 Claims, 6 Drawing Sheets

REVERSING SWITCH MECHANISM

BACKGROUND OF THE INVENTION

This invention relates generally to reversing switches, and more particularly, to reversing switch mechanisms for power tools.

A wide variety of electrical switches have been proposed for various industrial and commercial applications. Some examples of industrial and commercial applications for electrical switches relate to hand held power tools, such as electric drills screw drivers, having electric motors to power a chuck holding a tool. Such power tools usually include a trigger which is manually operated by a user with the motor being controlled by the user pressing the trigger. Some power tools include a reversing switch mechanism between a power source for the power tool and the motor. The reversing switch mechanism may be switched between a forward and a rearward mode of operation to control the direction of rotation of the chuck. Typically, the switch mechanism is positioned in a housing, and a plurality of wires are coupled to the switch mechanism.

However, problems exist with manufacture and assembly of conventional switch mechanisms, as space constraints within the power tool limit the overall size of the switch mechanisms. As such, the components of the switch mechanism are small and assembly of the switch mechanisms may be time consuming and difficult. Additionally, conventional switch mechanisms include contacts having different and complex shapes, which are routed through the housing to mate with the wires coupled to the switch mechanism. The different shapes increase the overall cost of the switch mechanism by requiring additional tooling to form the contacts, and the complexity of the contacts lead to additional assembly time to manufacture the switch mechanism.

BRIEF DESCRIPTION OF THE INVENTION

In one aspect, a reversing switch mechanism is provided including a housing defining contact cavities and a trough, contacts received in the contact cavities, and a slide member received in the trough and engaging the contacts. The slide member includes conductive elements forming conductive paths along the slide member. The slide member movable with respect to the contacts along a linear path between a forward position and a rearward position, wherein the contacts engage the conductive elements in a first conductive configuration in the forward position and the contacts engage the conductive elements in a second conductive configuration in the rearward position.

Certain embodiments of the reversing switch mechanism may include a first pair of the contacts engaging a first side of the slide member and a second pair of the contacts engaging a second side of the slide member. Optionally, each of the contacts of the first pair form a conductive path when the slide member is in the forward position, and each of the contacts of the second pair form a conductive path when the slide member is in the forward position. Additionally, one of the contacts of the first pair may form a conductive path with one of the contacts of the second pair when the slide member is in the rearward position, and the other of the contacts of the first pair may form a conductive path with the other of the contacts of the second pair when the slide member is in the rearward position.

Certain embodiments of the reversing switch mechanism may also include a first conductive element and a second conductive element wherein each of the contacts of the first pair engage the first conductive element when the slide member is in the forward position, and each of the contacts of the second pair engage the second conductive element when the slide member is in the forward position. Additionally, one of the contacts of the first pair and one of the contacts of the second pair may engage the first conductive element when the slide member is in the rearward position, and the other of the contacts of the first pair and the other of the contacts of the second pair may engage the second conductive element when the slide member is in the rearward position.

In another aspect, a reversing switch mechanism is provided including a housing defining contact cavities and contacts received in the contact cavities, wherein each of the contact have a substantially similar shape. A slide member is received in the housing and engages the contacts. The slide member includes conductive elements forming conductive paths within the slide member, and the slide member movable with respect to the contacts between a forward position and a rearward position. The contacts engage the conductive elements in a first conductive configuration in the forward position and the contacts engage the conductive elements in a second conductive configuration in the rearward position.

DETAILED DESCRIPTION OF THE INVENTION

Figure 1:
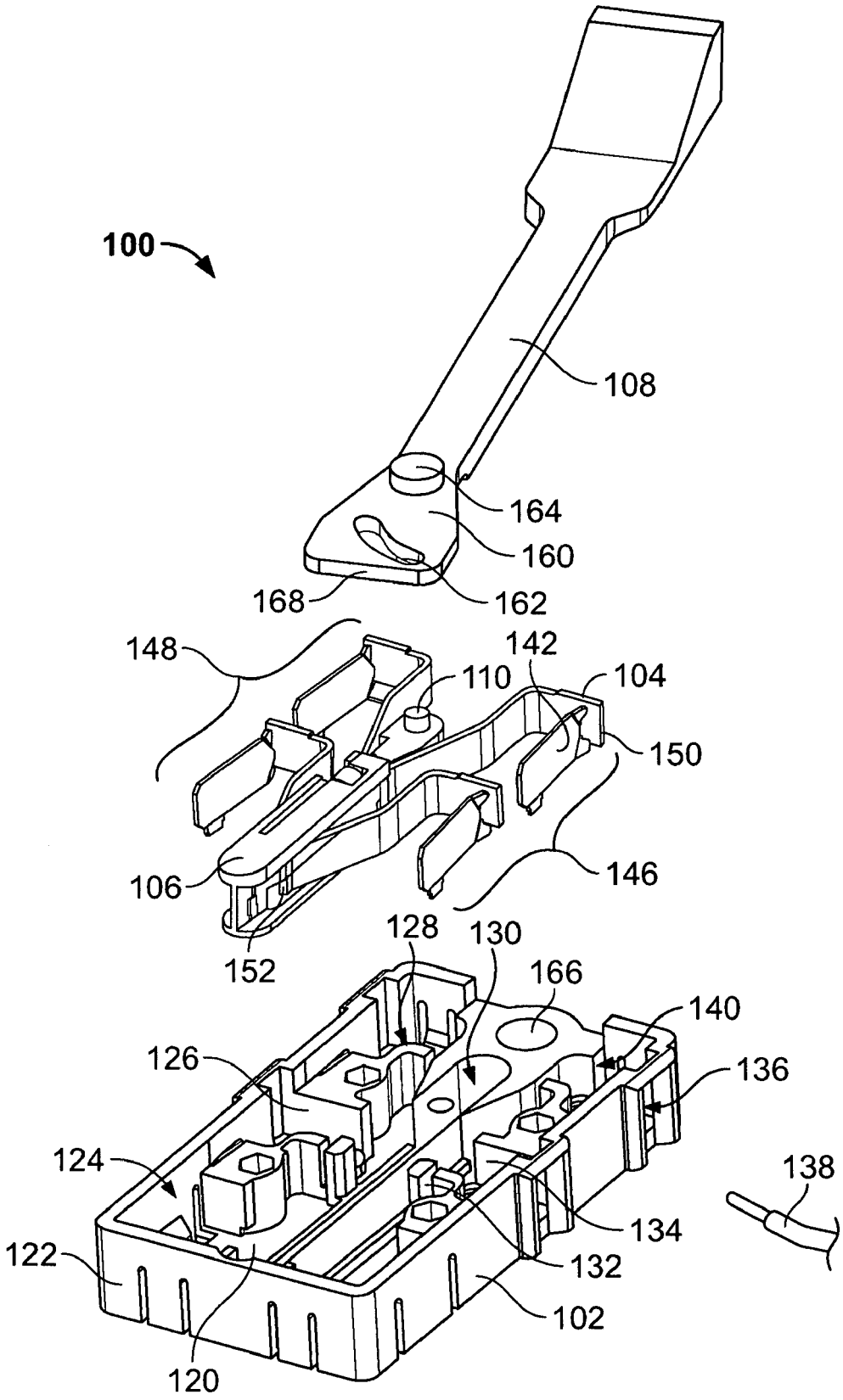
FIG. 1 is an exploded perspective view of a reversing switch mechanism in accordance with an exemplary embodiment of the present invention.

FIG. 1 is an exploded perspective view of a reversing switch mechanism 100 for an electrical device, such as a power tool. The reversing switch mechanism 100 includes a housing 102 receiving a plurality of contacts 104 and a slide member 106. The slide member 106 is movable within the housing 102 between a forward position and a rearward position, and the contacts 104 engage different portions of the slide member 106 as the slide member 106 is moved between the forward position and the rearward position. The reversing switch mechanism 100 also includes an actuator arm 108 coupled to a pin 110 of the slide member 106 for moving the slide member 106 between the forward and rearward positions.

The housing 102 includes a back wall 120 and side walls 122. The back wall 120 and the side walls 122 define a housing cavity 124. When assembled, the contacts 104, the slide member 106, and the actuator arm 108 are each received within the housing cavity 124. The housing 102 also includes inner walls 126 defining contact cavities 128 within the housing cavity 124. The inner walls 126 also define a trough 130 within the housing cavity 124. The trough 130 receives the slide member 106 therein, and guides the slide member 106 as the slide member 106 is moved between the forward and rearward positions. The inner walls 126 further define contact slots 132 and contact supporting surfaces 134 for positioning and supporting the contacts 104 within the contact cavities 128. Portions of the contacts 104 are thus rigidly fixed in place within the housing 102. At least some of the side walls 122 of the housing 102 include openings 136 for receiving wires 138 therein. Each wire 138 extends into a wire trap area 140 of one of the contact cavities 128. The wires 138 are secured within the wire trap areas 140 by wire trap members 142. Optionally, the wires 138 are trapped between a respective one of wire trap members 142 and a corresponding one of the contacts 104. As a result, an electrical connection is made between the contacts 104 and the wires 138. Alternatively, the wires 138 may be mechanically coupled to the contacts 104, such as by using a fastener, a clip, or a solder connection.

In an exemplary embodiment, four contacts 104 are provided within the reversing switch mechanism 100. The contacts 104 are arranged as a first pair 146 and a second pair 148, wherein the first pair 146 and the second pair 148 are arranged on opposite sides of the slide member 106. The contacts 104 extend between a wire engagement end 150 and a slide member engagement end 152. The contacts 104 are secured in position by the contact slots 132 and the contact supporting surfaces 134 such that the wire engagement end 150 is configured to engage the wires 138 during assembly. The slide member engagement end 152 is flexed generally inwardly toward the slide member 106. Optionally, the contacts 104 are pre-tensioned such that the slide member engagement end 152 is biased against the slide member 106 when assembled.

The actuator arm 108 includes a mounting portion 160 having an actuating slot 162 extending therethrough. Optionally, the mounting portion 160 also includes protrusions 164 extending from the mounting portion 160. The protrusions 164 are received in mounting bores 166 of the housing 102 and fix the relative position of the actuator arm 108 with respect to the housing 102. The protrusions 164 and mounting bores 166 are circular and allow rotational movement of the actuator arm 108 with respect to the housing 102. Alternatively, the mounting bore may be elongated such that the actuator arm 108 may be moved with respect to the housing 102.

The actuating slot 162 receives the pin 110 of the slide member 106. Optionally, the actuating slot 162 is arcuate or curved generally away from an end surface 168 of the mounting portion 160. The pin 110 is movable within the actuating slot 162 as the actuating arm 108 is moved. As such, movement of the actuator arm 108 is transferred to the slide member 106 via the pin 110. For example, the actuator arm 108 is moveable between a forward position and a rearward position, corresponding to the forward and rearward positions of the slide member 106. Optionally, the actuator arm 108 is rotated or pivoted between the forward and rearward positions, and the pin 110 travels along the arcuate actuating slot 162 as the actuator arm 108 is rotated. Alternatively, the actuating slot 162 may have a substantially similar shape and size as the pin 110. The actuator arm 108 is moved linearly with respect to the housing 102, such as in a direction that is substantially perpendicular to a side wall 122 of the housing 102. For example, the actuator arm 108 may be pushed into the housing 102 or pulled out of the housing 102 to move the slide member 106.

Figure 2:
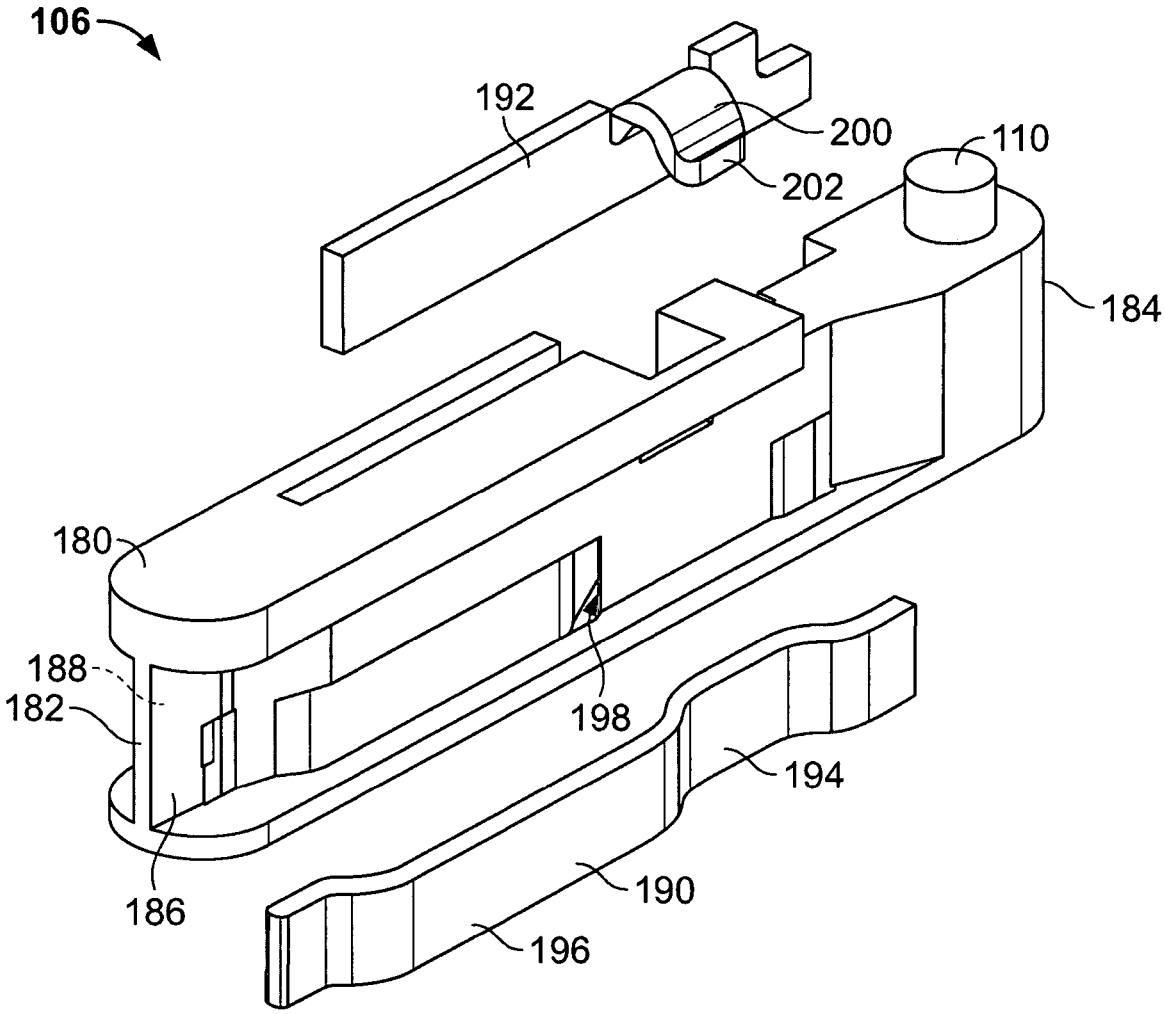
FIG. 2 is an exploded perspective view of a slide member of the reversing switch mechanism shown in FIG. 1.

FIG. 2 is an exploded perspective view of the slide member 106 of the reversing switch mechanism 100. The slide member 106 includes a body 180 extending between a first end 182 and a second end 184. The pin 110 is positioned proximate the second end 182. The body 180 is generally elongated between the first end 182 and the second end 184. The body 180 includes a first side 186 and a second side 188. The first side 186 and the second side 188 are generally planar and extend between the first end 182 and the second end 184. Alternatively, the body 180 may have a different shape, such as, for example, a circular shape, an oval shape, a wedge shape wherein the first end 182 and the second end 184 have different lengths, or an irregular shape.

The slide member 106 includes a first conductive element 190 extending along the first side 186 of the body 180 and a second conductive element 192 extending along the second side 188 of the body 180. The conductive elements 190 and 192 define conductive paths within the slide member 106, and interface with the contacts 104 (shown in FIG. 1) in the various positions of the slide member 106. The first conductive element 190 includes inwardly extending portions 194 that extend generally toward the body 180 and outwardly extending portions 196 that extend generally away from the body 180. The inwardly extending portions 194 are substantially coplanar with one another. Additionally, the outwardly extending portions 196 are substantially coplanar with one another. Optionally, when assembled, the outwardly extending portions 196 are exposed on an exterior portion of the slide member body 180 and the inwardly extending portions 194 are covered by a portion of the body 180. For example, in one embodiment, the outwardly extending portions 196 of the first conductive element 190 extend through slots 198 in first side 186 of the body 180. Optionally, the inwardly extending portions 194 may be exposed on the second side 188 of the body 180. In one embodiment, one of the inwardly extending portions 194 is positioned proximate the first end 182 of the body 180 and one of the outwardly extending portions 196 is positioned proximate the second end 184 of the body 180.

The second conductive element 192 is generally planar and includes a hook portion 200. The hook portion 200 extends from the second side 188 to the first side 186 of the body 180. An engagement surface 202 of the hook portion 200 is exposed on the first side 186. The second conductive element 192 is insulated from the first conductive element 190 by the body 180 such that the second conductive element 192 is electrically isolated from the first conductive element 190. Optionally, the hook portion 200 is substantially aligned with one of the inwardly extending portions 194 of the first conductive element 190.

Figure 3:
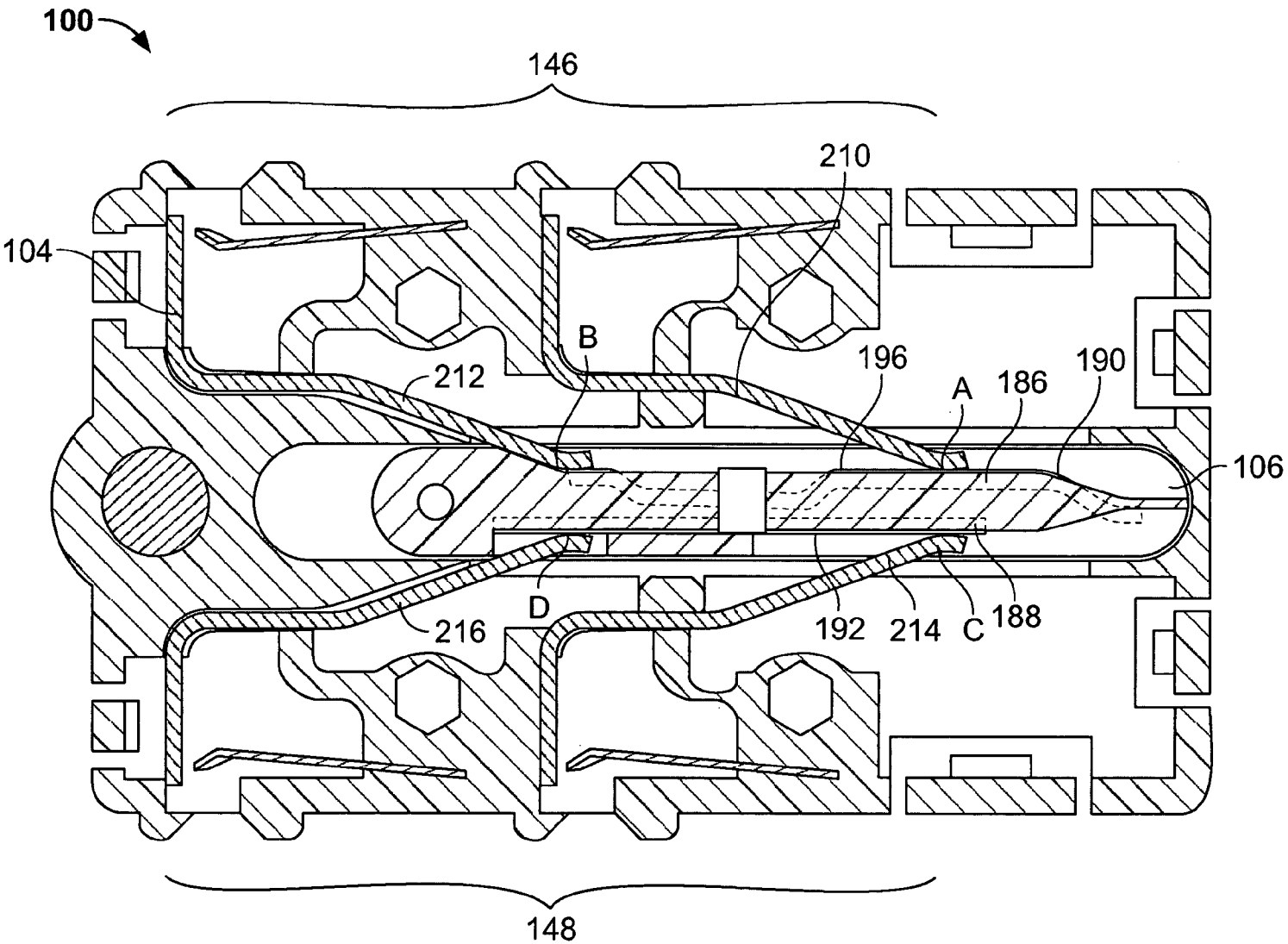
FIG. 3 is a top plan view of the reversing switch mechanism shown in FIG. 1 in a forward position.

FIG. 3 is a top plan view of the reversing switch mechanism 100 in a forward position. The actuator arm 108 (shown in FIG. 1) is removed for clarity. The contacts 104 are arranged such that the first pair 146 of contacts 104 are positioned along and engage the first side 186 of the slide member 106. The second pair 148 of contacts 104 are positioned along and engage the second side 188 of the slide member 106. Specifically, each of the contacts 104 of the first pair 146, also defined hereinafter as a first pair forward contact 210 and a first pair rearward contact 212, engage the outwardly extending portions 196 of the first conductive element 190, such as at point A and point B, respectively. The first pair forward contact 210 is electrically coupled to the first pair rearward contact 212 via the first conductive element 190. As such, a conductive path is defined through contacts 210 and 212 and element 190. Additionally, each of the contacts 104 of the second pair 148, also defined hereinafter as a second pair forward contact 214 and a second pair rearward contact 216, engage the second conductive element 192, such as at point C and point D, respectively. The second pair forward contact 214 is electrically coupled to the second pair rearward contact 216 via the second conductive element 192. As such, a conductive path is defined through contacts 214 and 216 and element 192.

Two conductive paths are created. The conductive paths in the forward position are intra-pair conductive paths, wherein each conductive path is conducted through the contacts 104 within each contact pair. For example, a first conductive path is conducted from the first pair forward contact 210, through the first conductive element 190, and then through the first pair rearward contact 212. Additionally, a second conductive path is conducted from the second pair forward contact 214, through the second conductive element 192, and then through the second pair rearward contact 216. The contacts 104 of the first pair 146 and the contacts 104 of the second pair 148 are isolated from one another.

Figure 4:
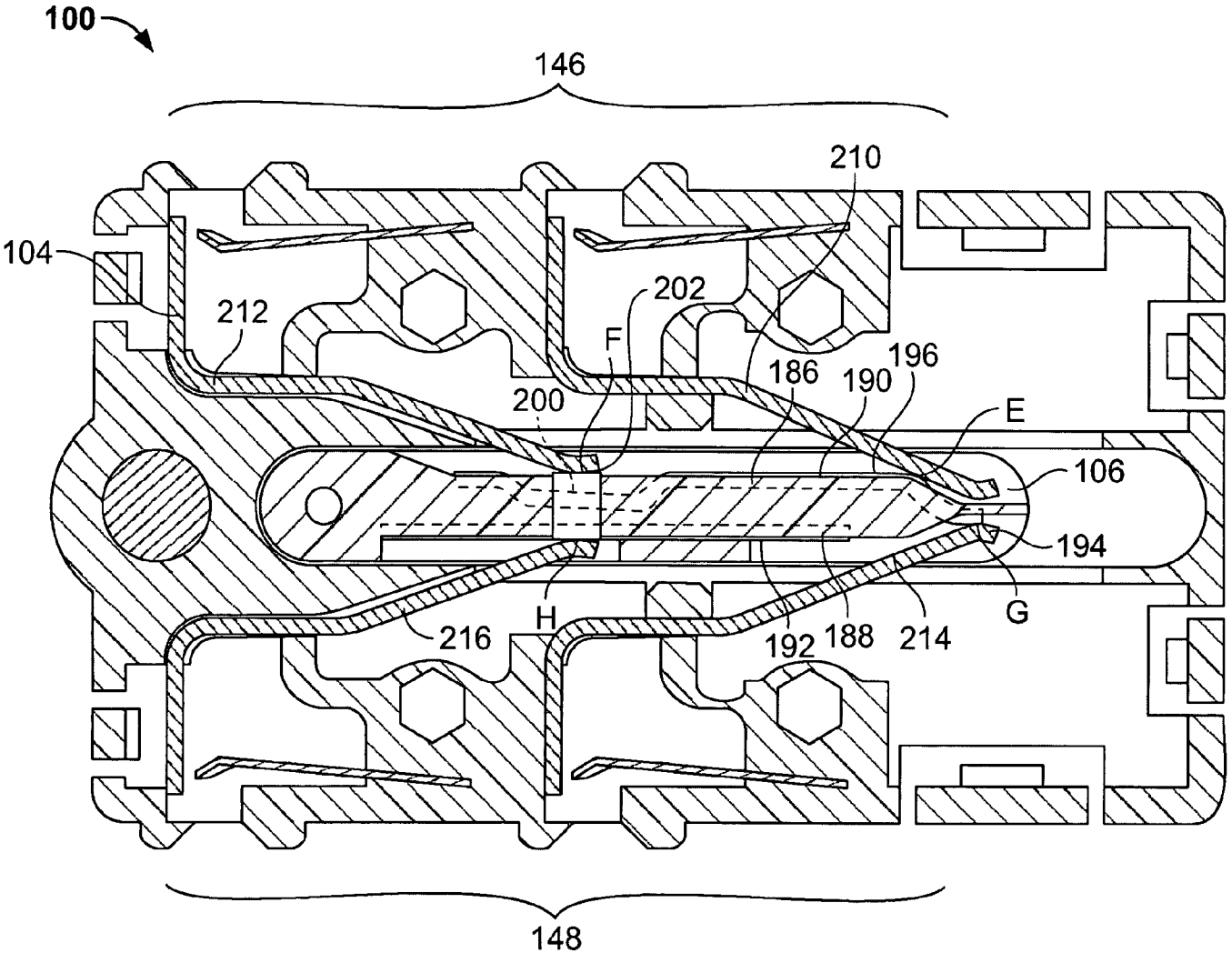
FIG. 4 is a top plan view of the reversing switch mechanism shown in FIG. 1 in a rearward position.

FIG. 4 is a top plan view of the reversing switch mechanism 100 in a rearward position. The actuator arm 108 (shown in FIG. 1) is removed for clarity. The contacts 104 are arranged such that the first pair 146 of contacts 104 are positioned along and engage the first side 186 of the slide member 106. The second pair 148 of contacts 104 are positioned along and engage the second side 188 of the slide member 106. When the slide member 106 is moved from the forward position (shown in FIG. 3) to the rearward position, the conductive paths through the contacts 104 are changed or switched. As such, the electrical device housing the reversing switch mechanism 100, such as the power tool, may be operated in a different manner. For example, the electrical device may be an electric drill and the drive direction of the drill may be switched when the reversing switch mechanism 100 is moved from the forward position to the rearward position.

In the rearward position, the first pair forward contact 210 and the second pair forward contact 214 engage the first conductive element 190. For example, the first pair forward contact 210 engages the forward-most outwardly extending portion 196 of the first conductive element 190 (point E) and the second pair forward contact 214 engages the forward-most inwardly extending portion 194 of the first conductive element 190 (point F). The first pair forward contact 210 is electrically coupled to the second pair forward contact 214 via the first conductive element 190. As such, a conductive path is defined through contacts 210 and 214 and element 190. Additionally, the first pair rearward contact 212 and the second pair rearward contact 216 engage the second conductive element 192. For example, the first pair rearward contact 212 engages the engagement surface 202 of the hook portion 200 (point G) and the second pair rearward contact 216 engages the second conductive element 192 (point H). The first pair rearward contact 212 is electrically coupled to the second pair rearward contact 216 via the second conductive element 192. As such, a conductive path is defined through contacts 212 and 216 and element 192.

Two conductive paths are created. The conductive paths in the rearward position are inter-pair conductive paths, wherein each conductive path is conducted from one contact 104 of the first pair 146 to one contact 104 of the second pair 148. For example, a first conductive path is conducted from the first pair forward contact 210, through the first conductive element 190, and then through the second pair forward contact 214. Additionally, a second conductive path is conducted from the first pair rearward contact 212, through the second conductive element 192, and then through the second pair rearward contact 216. The contacts 104 of the first pair 146 and the contacts 104 of the second pair 148 are electrically connected with one another.

Figure 5:
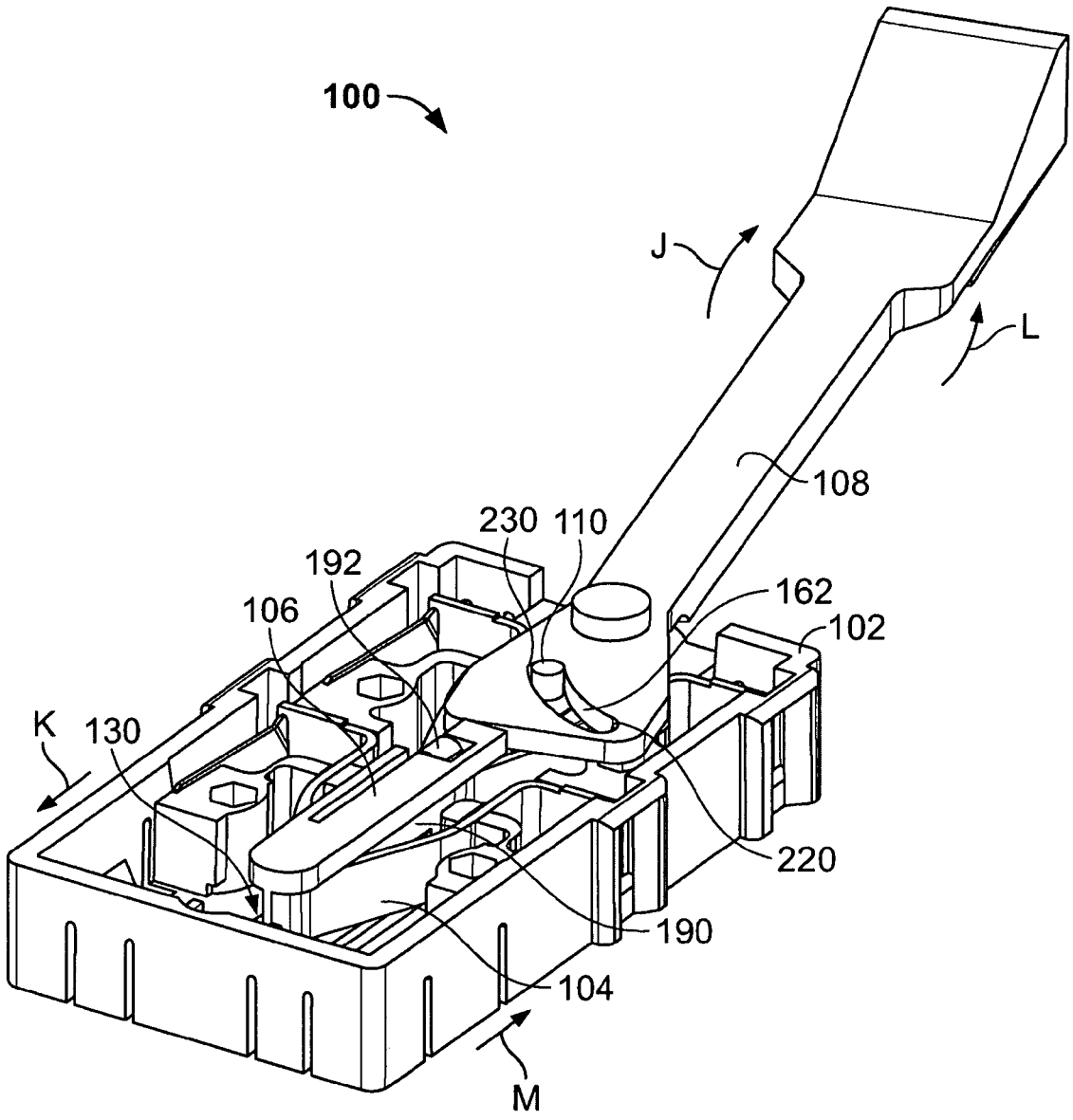
FIG. 5 is an assembled perspective view of the reversing switch mechanism shown in FIG. 1.

FIG. 5 is an assembled perspective view of the reversing switch mechanism 100. The actuator arm 108 and the slide member 106 are illustrated in a rearward position. When assembled, the actuator arm 108 is mounted to the housing 102. The pin 110 extending from the slide member 106 is received within the actuating slot 162. The pin 110 is movable between a forward end 220 of the actuating slot 162 and a rearward end 222 of the actuating slot 162. The forward end 220 and the rearward end 22 define stops for the actuator arm 108.

In operation, the actuator arm 108 is rotated between the forward position and the rearward position. The actuator arm 108 transfers the rotational movement of the actuator arm 108 to linear movement of the slide member 106 between the forward position and the rearward position. For example, as the actuator arm 108 rotates, the pin 110 is moved within the actuating slot 162. Because the actuating slot 162 extends generally away from the end surface 168 of the actuator arm 108, a linear position of the pin 110 within the housing 102 is changed. The slide member 106 is thus moved within the housing 102. The trough 130 guides the slide member 106 within the housing 102.

In operation, the slide member 106 is moved from the rearward position (shown in FIG. 5) to the forward position by rotating the actuator arm 108 in a clockwise direction, such as in the direction of arrow J. When the actuator arm 108 is rotated in the direction of arrow J, the slide member 106 is moved in a linear direction, such as in the direction of arrow K, to the forward position. As the slide member 106 is moved from the rearward position to the forward position, the conductive paths through the reversing switch mechanism 100 are changed, and different contacts 104 are electrically coupled with one another. To switch the slide member 106 from the forward position to the rearward position, the actuator arm 108 is rotated in a counter-clockwise direction, such as in the direction of arrow L. When the actuator arm 108 is rotated in the direction of arrow L, the slide member 106 is moved in a linear direction, such as in the direction of arrow M, to the forward position.

Figure 6:
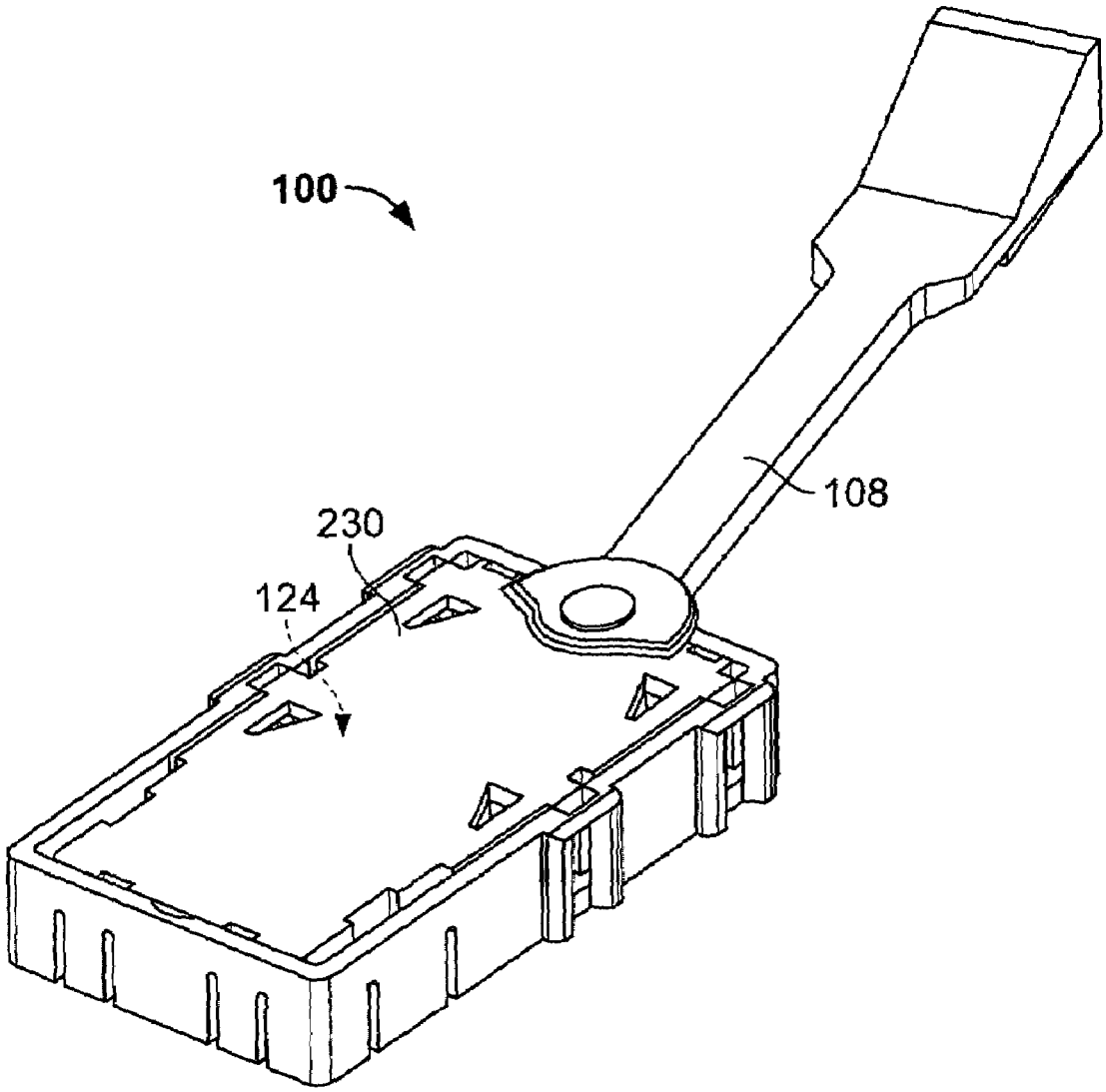
FIG. 6 is an assembled perspective view of the reversing switch mechanism shown in FIG. 1 with a lid.

FIG. 6 is an assembled perspective view of the reversing switch mechanism 100 with a lid 230. The lid 230 closes the housing cavity 124 and secures the components of the reversing switch mechanism 100 within the housing cavity 124. Additionally, the lid 230 captures the actuator arm 108 to allow rotation of the actuator arm 108 between the forward and rearward positions.

The above-described embodiments provide a cost effective and reliable means for developing a reversing switch mechanism 100. Specifically, the reversing switch mechanism 100 includes a plurality of contacts 104 received within a housing 102. A slide member 106 is also received within the housing 102 and is movable with respect to the contacts 104. In the exemplary embodiment, the slide member 106 is movable in a linear direction between a forward position and a rearward position. The contacts engage conductive elements 190, 192 of the slide member 106 in the forward position and the contacts engage different conductive elements 190, 192 in the rearward position such that the conductive paths of the reversing switch mechanism 100 is changed between the forward and rearward positions. Additionally, each of the contacts 104 are have a substantially similar shape. As a result, the reversing switch mechanism 100 has a reduced number of parts and may be fabricated at a reduced cost. Additionally, assembly time may be reduced.

While the invention has been described in terms of various specific embodiments, those skilled in the art will recognize that the invention can be practiced with modification within the spirit and scope of the claims.

What is claimed is:

1. A reversing switch mechanism comprising:

a housing defining contact cavities and a trough;

contacts received in said contact cavities;

a slide member received in said trough and engaging said contacts, said slide member comprising parallel first and second sides extending along a longitudinal axis of said slide member, said slide member movable with respect to said contacts along a linear path substantially parallel to said longitudinal axis between a forward position and a rearward position; and first and second conductive elements forming conductive paths along said slide member, said first and second conductive elements being exposed on each of said first and second sides of said slide member, wherein said contacts engage said conductive elements in a first conductive configuration in said forward position and said contacts engage said conductive elements in a second conductive configuration in said rearward position.

2. The reversing switch mechanism of claim 1, wherein a majority of said first conductive element is positioned on said first side of said slide member and a majority of said second conductive element is positioned on said second side of said slide member.

3. The reversing switch mechanism of claim 1, wherein a first pair of said contacts engage said first side of said slide member and a second pair of said contacts engage said second side of said slide member.

4. The reversing switch mechanism of claim 3, wherein each of said contacts of said first pair form a conductive path when said slide member is in said forward position, and each of said contacts of said second pair form a conductive path when said slide member is in said forward position.

5. The reversing switch mechanism of claim 3, wherein one of said contacts of said first pair form a conductive path with one of said contacts of said second pair when said slide member is in said rearward position, and the other of said contacts of said first pair form a conductive path with the other of said contacts of said second pair when said slide member is in said rearward position.

6. The reversing switch mechanism of claim 3, wherein each of said contacts of said first pair engage said first conductive element when said slide member is in said forward position, and each of said contacts of said second pair engage said second conductive element when said slide member is in said forward position.

7. The reversing switch mechanism of claim 3, wherein one of said contacts of said first pair and one of said contacts of said second pair engage said first conductive element when said slide member is in said rearward position, and the other of said contacts of said first pair and the other of said contacts of said second pair engage said second conductive element when said slide member is in said rearward position.

8. The reversing switch mechanism of claim 1, wherein each of said contacts have a substantially similar shape.

9. The reversing switch mechanism of claim 1, wherein each of said contacts are flexed toward said slide member.

10. The reversing switch mechanism of claim 1, further comprising wire trap members received within said housing, each said wire trap member configured to cooperate with a respective one of said contacts to form a wire trap for a wire.

11. The reversing switch mechanism of claim 1, further comprising an actuator arm coupled to said slide member, said actuator arm moveable between a forward position and a rearward position.

12. The reversing switch mechanism of claim 11, wherein said actuator arm comprises an arcuate actuating slot, said slide member comprises a pin received within said actuating slot, said actuator arm being rotatable between said forward position and said rearward position.

13. The reversing switch mechanism of claim 1, wherein said trough comprises side walls having openings therein, said contacts extending through said openings of said side walls.

14. A reversing switch mechanism comprising:

a housing defining contact cavities and a trough;

flexible contacts received in said contact cavities and flexing toward said trough, each said contact having a substantially similar shape; and a slide member received in said housing and engaging said contacts, said slide member comprising conductive elements forming conductive paths within said slide member, said slide member movable with respect to said contacts between a forward position and a rearward position, wherein said contacts engage said conductive elements in a first conductive configuration in said forward position and said contacts engage said conductive elements in a second conductive configuration in said rearward position.

15. The reversing switch mechanism of claim 14, wherein said slide member is movable along a linear path.

16. The reversing switch mechanism of claim 14, wherein each said contact is formed using a substantially similarly shaped die.

17. The reversing switch mechanism of claim 14, wherein a first pair of said contacts engage a first side of said slide member and a second pair of said contacts engage a second side of said slide member, each of said contacts of said first pair form a conductive path when said slide member is in said forward position, and each of said contacts of said second pair form a conductive path when said slide member is in said forward position.

18. The reversing switch mechanism of claim 14, wherein a first pair of said contacts engage a first side of said slide member and a second pair of said contacts engage a second side of said slide member, one of said contacts of said first pair form a conductive path with one of said contacts of said second pair when said slide member is in said rearward position, and the other of said contacts of said first pair form a conductive path with the other of said contacts of said second pair when said slide member is in said rearward position.

19. The reversing switch mechanism of claim 14, wherein said slide member comprises parallel first and second sides extending along a longitudinal axis of said slide member, the linear path of movement being substantially parallel to said longitudinal axis and wherein said conductive elements comprise first and second conductive elements being exposed on each of said first and second sides of said slide member.

20. The reversing switch mechanism of claim 14, wherein said contacts are initially disposed within said trough, and wherein said contacts are at least partially displaced by said slide member when said slide member is received within said trough, wherein the displacement of said contacts provides a positive force on said contacts in the direction of said slide member.

* * * * *